United States Patent [19]

Stussi

[11] 4,417,429

[45] Nov. 29, 1983

[54] FREESTANDING STAIR ASSEMBLY AND RISER THEREFOR

[76] Inventor: Hans Stussi, R.R. #1, Cochrane, Alberta, Canada, T0L 0W0

[21] Appl. No.: 300,550

[22] Filed: Sep. 9, 1981

[30] Foreign Application Priority Data

Sep. 12, 1980 [CA] Canada ..... 360198

[51] Int. Cl.[3] ..... E04F 11/00; E04F 19/10

[52] U.S. Cl. ..... 52/182; 52/184; 52/593; 52/608

[58] Field of Search ..... 52/182, 184, 187, 608, 52/190, 593; 405/287

[56] References Cited

U.S. PATENT DOCUMENTS

| | | | |
|---|---|---|---|
| 607,812 | 7/1898 | Van Wie | 52/608 |
| 834,950 | 11/1906 | Van Wie | 52/608 |
| 1,883,214 | 10/1932 | Wilson et al. | 52/593 |
| 2,520,452 | 8/1950 | Brune, Sr. | 52/190 |
| 2,653,450 | 9/1953 | Fort | 405/287 |
| 2,892,340 | 7/1955 | Fort | 52/593 |
| 3,343,316 | 9/1967 | McIntire | 52/190 |
| 3,474,882 | 10/1969 | Ernst | 182/106 |
| 3,491,498 | 1/1970 | Hughes, Jr. | 52/228 |
| 3,964,222 | 6/1976 | Geleijnse et al. | 52/187 |

FOREIGN PATENT DOCUMENTS

| | | | |
|---|---|---|---|
| 1005964 | 1/1977 | Canada | 52/190 |

*Primary Examiner*—John E. Murtagh
*Assistant Examiner*—Mark J. Sofia
*Attorney, Agent, or Firm*—Jones, Tullar & Cooper

[57] ABSTRACT

A freestanding stair assembly which is simple and chemical to produce and assemble is disclosed. The assembly utilizes a plurality of interengagable tubular links each of which is provided with pair of axially directed parallel slots in the annular wall. The slots extend from one end of the link and are oriented and dimensioned so as to receive therein the other end of a superjacent link. The links may be rotated relative to each other to achieve a linear or a non-linear stairway. Each link is adapted to have a stair tread member secured thereto. Also each main slot may be provided with a locking slot in the annular wall which is perpendicular to the main slot. Each riser may than have a lower flange at the other end, which flange can engage with the locking slots as relative rotation of the risers is performed. The circumferential extent of the lower flange is such that adjacent risers are locked together thereby at any reasonable relative angular orientation. The uppermost and lowermost risers are adapted to be respectively secured to an upper support such as a joist, and a base support, such as a floor. With the invention a spiral staircase, for example, may be achieved without requiring a central support pole.

14 Claims, 8 Drawing Figures

FREESTANDING STAIR ASSEMBLY AND RISER THEREFOR

The present invention relates to a freestanding stair assembly in general and to a simple riser member therefor in particular.

BACKGROUND OF THE INVENTION

Freestanding stair assemblies are well known in the art, the most common being the spiral staircase having interengageable risers on each of which a stair tread is secured. Such spiral staircases often require a central vertical pole to which each tread, or each preformed riser assembly is secured. Such systems are complex and expensive. Other systems exist which avoid the use of a central stabilizing pole, such systems depending on the integrity of the interengagement between vertically adjacent riser members to achieve structural rigidity. An example of such an assembly is found in Canadian Pat. No. 1,005,964 (Hamm) issued Mar. 1, 1977. Another system which dispenses with a vertical pole is found in U.S. Pat. No. 3,491,498 (Hughes, Jr.), issued Jan. 27, 1970 which shows links having serrated top and bottom edges and a sloped cylindrical wall. The serrated edges are intended to grip the stair tread although it is necessary to provide a hole in each tread for receipt of a cable which is stretched to apply a compressive load to the tread and riser assembly. Both of the aforementioned systems are expensive to produce and require considerable skill to assemble. Since such systems are aimed at the home handyman as well as at the general contractor it is desirable to provide a system which is simple to produce and assemble and which is also inexpensive at the retail level.

SUMMARY OF THE INVENTION

The present invention provides a freestanding stair assembly, and its riser component, which is simple and inexpensive to construct and which provides a structurally rigid assembly without requiring a vertical central stabilizing pole when the stair assembly is configured as a spiral staircase.

The heart of the present invention is the riser, to which a stair tread may be secured. Any style of tread may be used whether rectangular for a straight staircase, or sectored for a spiral staircase. The treads may be formed of wood or metal or any other material that may suit the user. Each riser is interengageable with the immediately superjacent and the immediately subjacent riser, with the exception of course of the uppermost and lowermost risers respectively, and each riser may be simply rotated relative to the immediately adjacent riser to achieve any desired non-linear staircase effect. A linear, or straight line, staircase is of course easily achievable. The lowermost and uppermost risers are provided with appropriate means whereby those risers may be secured to suitable support surfaces, such as a floor and a joist respectively.

As indicated hereinabove, each riser is simple in form and construction. Each riser is in the form of a tubular link of steel, cast-iron or any other suitable material and has a length appropriate to the height and aesthetics of the final stairway assembly. At one end thereof each riser may be provided with an outwardly projecting flange for the attachment of a tread thereto, as with screw-type fasteners. Extending parallel to the axis of the tubular link is a pair of slots which open at the one end. The slots are parallel to each other and each has a width which is slightly greater than the wall thickness of the link. The slots are circumferentially spaced apart and are shorter than one half the length of the link. The slots are dimensioned therefore and are spaced apart so as to be able to receive the annular wall of an immediately superjacent link therein. The interengaged links, when joined together in this fashion, may be oriented to produce a linear or straight-line assembly, or each link may be rotated relative to the immediately subjacent link to produce a non-linear assembly, such as a spiral staircase assembly.

In summary of the above, therefore, the present invention may be broadly defined as providing a riser for a freestanding stair assembly comprising a tubular link member having an annular wall portion, tread securing means at one end of said wall portion, and a pair of axially extending parallel slots formed in said wall portion, said slots being open at said one end, being spaced apart circumferentially and being dimensioned to receive the other end of the wall portion of a superjacent riser.

Furthermore, the present invention may be seen to encompass a freestanding stair assembly comprising a plurality of interengageable risers and a tread affixed to each riser, wherein each riser is a tubular link member having an annular wall portion, tread securing means at one end of said wall portion, and a pair of axially extending parallel slots formed in said wall portion, said slots being open at said one end, being spaced apart circumferentially and being dimensioned to receive the other end of the wall portion of a superjacent riser.

DESCRIPTION OF THE PREFERRED EMBODIMENT

Figure 1:
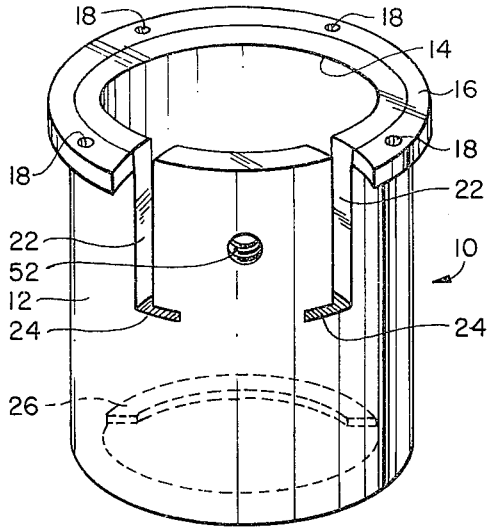
FIG. 1 is a perspective view of a riser link according to the present invention.

FIG. 1 illustrates the riser link 10 which is at the heart of the present invention. The link is tubular in cross-section and may be formed of steel, cast-iron, or any other material which will provide sufficient strength for the specific assembly to which it will be applied. Similarly, links may be produced in different heights and diameters so that the user may select appropriate links to meet his needs.

Each link is defined by an annular wall 12 defining a central through passageway 14. At the top end, a flange 16 is formed, which flange projects outwardly and extends circumferentially about a major portion of the wall 12. The flange 16 is provided with a plurality of bores 18 which are adapted to receive fastening means which secure the tread 20 (FIG. 2) to the flange. The bore 18 could be smooth with a countersunk portion on the underside of the flange whereby wood screws could be driven upwardly into a wooden tread. The bores 18 could also be threaded so as to receive machine screws driven downwardly through the tread.

Figure 2:
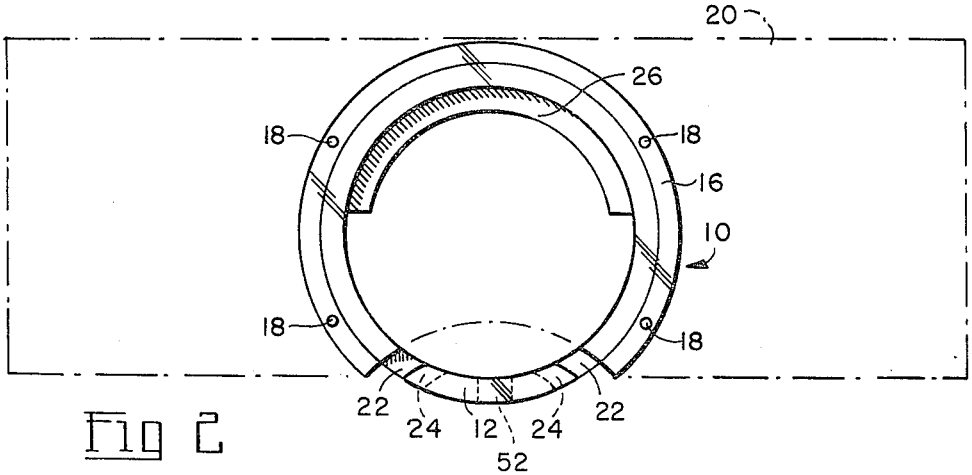
FIG. 2 is a top view of the riser link with a stair tread shown in phantom.

FIG. 1 also shows a pair of blind slots 22 which are formed in the wall 12 of the link 10. The slots 22 are spaced apart circumferentially and may extend downwardly a distance which is less than one-half the height of the link, the slots being parallel to each other and to the axis of the link. The width of each slot is slightly greater than the wall thickness of the link wall and, as seen in FIG. 2, each wall of each slot lies generally on an arc corresponding to the outer or inner wall surface of the superjacent link. For manufacturing purposes the walls of the slot may be straight as long as the width therebetween is as mentioned above. As seen clearly in FIGS. 1 and 2 the flange 16 terminates adjacent the outer walls of the slots, the portion of the wall 12 between the slots being devoid of any flange.

Figure 3:
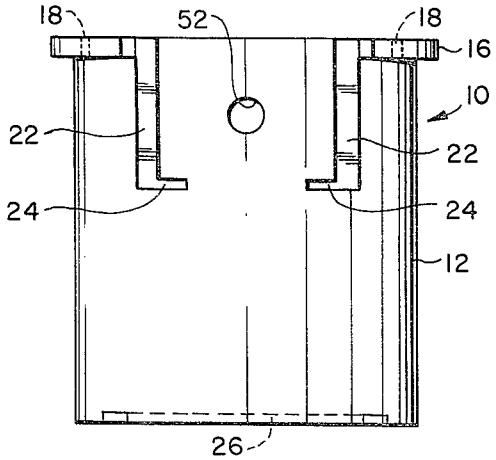
FIG. 3 is a front view of the riser link.

At the lower end of each slot 22 is a second slot 24 which extends through the wall 12 at right angles to the slot 22 and parallel to the flange 16. As seen in FIGS. 1 and 3 slots 24 are directed toward each other and are coplanar.

At the lower end of the link, projecting inwardly of the passageway 14 is a second flange 26. Flange 26 is a locking flange and has a thickness just slightly less than the height of each slot 24, as it is intended to cooperate therewith. Flange 26 extends around slightly less than one half of the inner circumference 14 and the lower surface thereof is coplanar with the bottom surface of the link 10.

Figure 7:
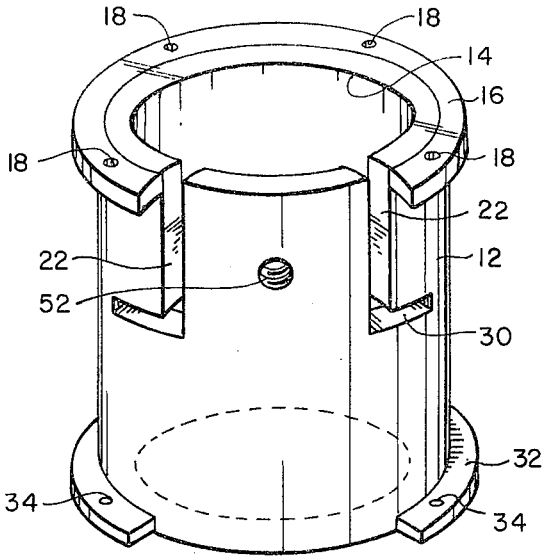
FIG. 7 is a view similar to FIG. 1 of a second embodiment of the present invention.
Figure 8:
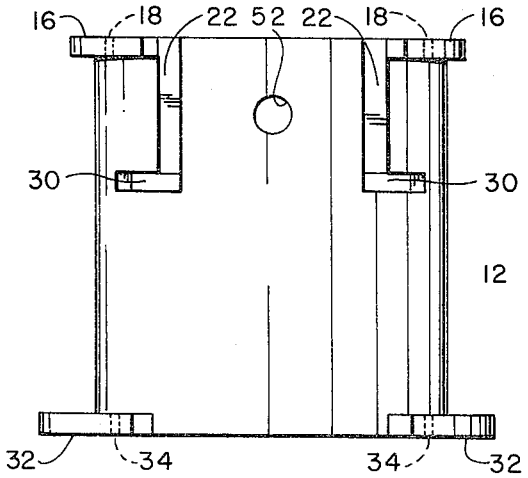
FIG. 8 is a view similar to FIG. 3 but depicting the second embodiment.

FIGS. 7 and 8 show a modification of the embodiment of FIGS. 1 and 3 wherein the slots 30 extend away from each other from their respective slots 22. A lower flange 32 is provided on the outer wall 12 in the same manner as flange 16 and is also provided with through-bores 34. The flange 32 could have the same circumferential extent as flange 16.

Figure 4:
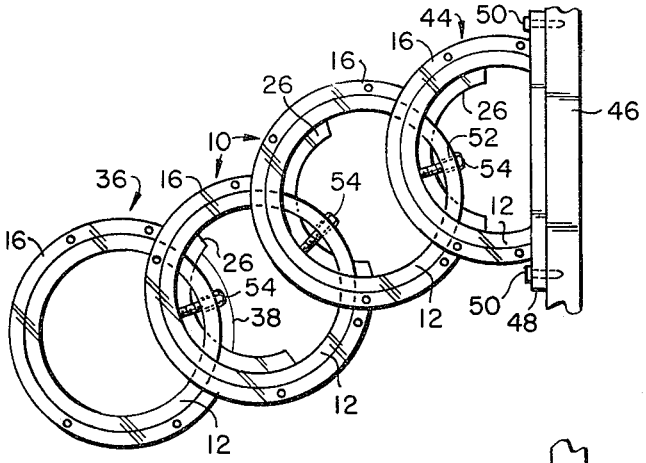
FIG. 4 is at top view of a non-linear stair assembly using riser links of the present invention.
Figure 5:
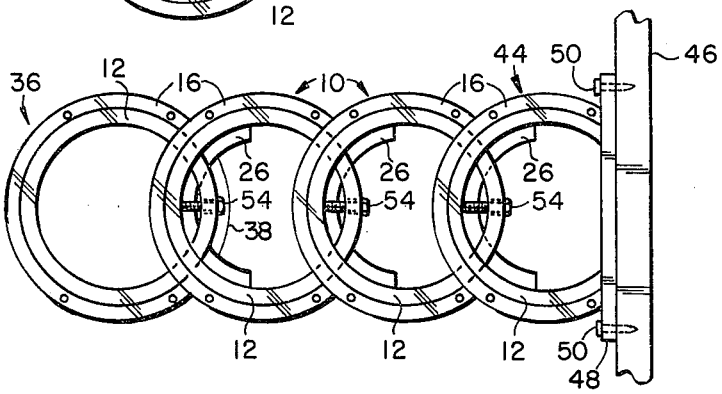
FIG. 5 is a top view of a linear stair assembly using riser links of the present invention.
Figure 6:
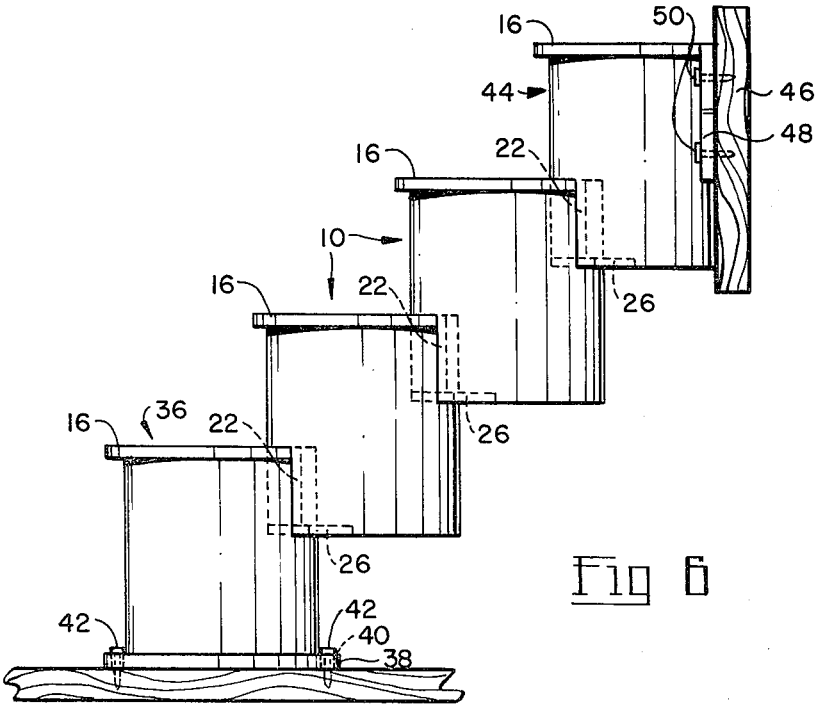
FIG. 6 is a side view of the linear assembly of FIG. 5.

The manner in which the riser links may be assembled together to form a staircase as depicted in FIGS. 4, 5 and 6 will now be described. It is seen that the links interengage and interlock to form the assembly.

In order to assemble the links together a first link is slipped into the slots 22 of a subjacent link with the lower wall portion which is devoid of flanges being introduced into the slots. The superjacent link is slid down into the slots of the subjacent link until the lower wall surface meets the bottom of the slots. The links are then rotated relative to each other until the bottom flange 26 or 32 enters the slots 24 or 30. Rotation is continued until the desired relative angular orientation of the links is achieved, whether for a non-linear stairway (as in FIG. 4) or for a linear stairway (as in FIG. 5). The interengagement of the flanges 26 or 32 with the slots 24 or 30 prevents any axial separation of the links once the desired relative orientation has been achieved and also prevents relative forward or backward movement between the links. The circumferential extent of the flanges 26 or 32 is sufficient to provide any appropriate and reasonable degree of non-linear orientation without unwanted separation of the links.

If the embodiment of FIG. 1 is utilized, that is a plurality of links having the internal flange 26, it is necessary to provide a base link 36 as shown in FIGS. 4, 5 and 6. Such a link has a lower flange 38 extending completely around the circumference, the flange 38 having through bores 40 for accepting suitable fastening means 42 for securing the base link to the floor or other base support. The upper construction of the base link 36 is otherwise identical to that of the link 10.

If the embodiment of FIG. 7 is utilized then the through-bores 34 could be utilized to fasten any link to the floor or other support as the flange 32 would then perform the same function as the flange 38 on a base link 38. With this embodiment it would not be necessary to provide a separately constructed base link and hence the manufacturing process could be slightly simplified. The links of this embodiment would be otherwise assembled in the same manner as the links of the first embodiment.

With either embodiment it is necessary to provide an uppermost support link 44 which is secured to a joist or other upper support 46 at the top of the stairwell. Such a link 44 would have a upper portion of the wall 12 sliced therefrom and replaced by a flat portion 48 welded or otherwise secured thereto. In order to permit the support link 44 to be assembled to the subjacent link 10 the lower edge of plate 48 must be spaced above the lower edge of the wall 12 a distance at least as great as the vertical distance between the lower surface of slot 24, or 30 and the top surface of the flange 16. The wall portion below the plate 48 may extend thereunder, if desired, terminating in a vertical face which is coplanar with the outer mounting face of the plate 48. As seen in FIGS. 4, 5 and 6, fasteners such as lag screws 50 secure the support link 44 to the joist or other support 46.

When assembling a stairway utilizing riser links according to the present invention the desired number of links would be assembled together and the links rotated relative to each other until the desired configuration is achieved. All links may be assembled and oriented before securing the uppermost and lowermost links to their respective supports as the interlocking feature provided by the flanges 26, 32 and recesses 24, 30 will keep the links together in the general desired orientation. Alternatively it would be possible to secure one of the uppermost or lowermost links to its respective support and to then assemble the links together one at a time, starting with the secured link, until the other securing link is assembled. It would, of course, be easiest to start with the lowermost link as the first secured link so as to avoid any difficulty when the time comes to assemble the last link to the assembly. Once the risers are positioned and secured as desired the tread members may be assembled to the risers in an appropriate fashion. In this regard it is noted that the treads have been omitted from FIGS. 4, 5 and 6 for clarity and that the tread on the uppermost link would normally be either spaced an appropriate distance below the upper floor surface or would be coplanar therewith. Such dimensioning would have to be taken into account when the stairway is designed.

Since the height of each link is shown and the depth of the slots 22 is known it is a very simple exercise for the home handyman to ascertain the number of riser links that he will have to utilize. Whether a linear or a non-linear stairway is chosen will depend on aesthetics and/or the space available.

In order to strengthen the assembled stairway each riser may be provided with a threaded bore 52 extending through the wall portion 12 and positioned between the slots 22 approximately midway between the top surface of the riser and the slots 24 or 30. Such bore 52 may receive a threaded bolt 54, shown in FIGS. 4 and 5, which bolt may be tightened against the inner wall of the superjacent riser. While not specifically illustrated the bolt 54 could be provided with a pointed end which, upon tightening of the bolt, would dig into the material of the inner wall of the superjacent riser to increase the locking strength thereof. Needless to say the bolt 54 would be tightened only after the desired stairway configuration has been finalized, the bolts after tightening preventing any unwanted relative rotation between interlocking risers.

It is understood that modifications within the purview of a skilled person in the art could be introduced into the present invention and hence the protection to be afforded the invention should be determined by the claims appended hereto.

The embodiments of the invention in which an exclusive property or privilege is claimed are defined as follows:

1. A riser for a freestanding stair assembly comprising a tubular link member having an annular wall portion, tread securing means at one end of said wall portion, and a pair of axially extending parallel slots formed in said wall portion, said slots being open at said one end, being spaced apart circumferentially and being dimensioned to receive the other end of the wall portion of a superjacent riser, wherein said tread securing means comprises a tread securing flange extending outwardly from said annular wall portion, said flange extending circumferentially about said annular wall portion along a major portion thereof between said slots and being provided with fastener receiving means.

2. A riser according to claim 1 and including, for each of said slots, a locking slot extending through said wall portion parallel to said flange, the locking slots being directed toward each other, said riser also including a locking flange adjacent the other end thereof, said locking flange projecting inwardly from the inner wall surface of said annular wall portion and adapted for sliding engagement with the locking slots of a subjacent riser when two adjacent risers are assembled together and rotated relative to each other.

3. A riser according to claim 1 and including, for each of said slots, a locking slot extending through said wall portion parallel to said flange, the locking slots being directed away from each other, said riser also including a locking flange adjacent the other end thereof, said locking flange extending outwardly from the outer wall surface of said annular wall portion and adapted for sliding engagement with the locking slots of a subjacent riser when two adjacent risers are assembled together and rotated relative to each other.

4. A riser according to claim 3 wherein said tread securing flange and said locking flange have the same circumferential extent.

5. A riser according to claim 3 or claim 4 wherein said locking flange is provided with fastener receiving means.

6. A freestanding stair assembly comprising a plurality of interengaged risers and a tread affixed to each riser, wherein each riser is a tubular link member having an annular wall portion, tread securing means at one end of said wall portion, and a pair of axially extending parallel slots formed in said wall portion, said slots being open at said one end, being spaced apart circumferentially and being dimensioned to receive the other end of the wall portion of the superjacent riser.

7. An assembly according to claim 6 wherein said tread securing means comprises a tread securing flange extending outwardly from said wall portion, said flange extending circumferentially about said wall portion along a major portion thereof between said slots and being provided with fastener receiving means.

8. An assembly according to claim 7 and including, for each of said slots, a locking slot extending through said wall portion parallel to said flange, the locking slots being directed toward each other, said riser also including a locking flange adjacent the other end thereof, said locking flange projecting inwardly from the inner wall surface of said annular wall portion and adapted for sliding engagement with the locking slots of a subjacent riser when two adjacent risers are assembled together and rotated relative to each other.

9. An assembly according to claim 7 including, for each of said slots, a locking slot extending through said wall portion parallel to said flange, the locking slots being directed away from each other, said riser also including a locking flange adjacent the other end thereof, said locking flange extending outwardly from the outer wall surface of said annular wall portion and adapted for sliding engagement with the locking slots of subjacent riser when two adjacent risers are assembled together and rotated relative to each other.

10. An assembly according to claim 9 wherein said tread securing flange and said locking flange have the same circumferential extent.

11. An assembly according to claim 8 wherein a lowermost riser has an outwardly projecting, circumferentially extending flange at the other end thereof, said circumferentially extending flange being adapted for securing the lowermost riser to a base surface for the assembly, and wherein an uppermost riser has an axially extending plate secured thereto, said plate being adapted for securing the uppermost riser to an upper support surface.

12. An assembly according to claim 9 or 10 wherein said locking flange is provided with fastener receiving means whereby the lowermost riser of said assembly may be secured to a base surface for the assembly, and wherein the uppermost riser has an axially extending plate secured thereto for securing the uppermost riser to an upper support surface.

13. A riser according to claim 2 or claim 3 and including a threaded bore through said wall portion positioned between said parallel slots and between said one end and said locking slots, said bore being adapted to receive a threaded locking bolt therein.

14. An assembly according to claim 8 or claim 9 wherein each of said risers is provided with a threaded bore through said wall portion positioned between said parallel slots and between said one end and said locking slots, said bore being adapted to receive a threaded bolt therein for locking engagement with the inner wall surface of a superjacent riser.

* * * * *